United States Patent [19]

Shubaly

[11] Patent Number: 4,714,834

[45] Date of Patent: Dec. 22, 1987

[54] METHOD AND APPARATUS FOR GENERATING ION BEAMS

[75] Inventor: Murray R. Shubaly, Deep River, Canada

[73] Assignee: Atomic Energy of Canada, Limited, Ottawa, Canada

[21] Appl. No.: 767,048

[22] Filed: Aug. 19, 1985

Related U.S. Application Data

[63] Continuation-in-part of Ser. No. 703,502, Feb. 20, 1985.

[30] Foreign Application Priority Data

May 9, 1984 [CA] Canada ..... 4539753

[51] Int. Cl.[4] ..... H01J 27/20

[52] U.S. Cl. ..... 250/427; 313/360.1; 313/363.1; 315/111.81

[58] Field of Search ..... 250/427; 313/360.1, 313/363.1; 315/111.81

[56] References Cited

U.S. PATENT DOCUMENTS 3,238,414 3/1966 Kelley et al. ..... 250/427

FOREIGN PATENT DOCUMENTS 2362723 6/1975 Fed. Rep. of Germany ..... 250/427

OTHER PUBLICATIONS

Shubaly and Hamm, IEEE Transactions on Nuclear Science, vol. NS-28, No. 2, Apr. 1981, pp. 1316-1318.

Shubaly and deJong, IEEE Transactions on Nuclear Science, vol. NS-30, No. 2, Apr. 1983, pp. 1399-1401.

*Primary Examiner*—Craig E. Church

*Assistant Examiner*—Jack I. Berman

*Attorney, Agent, or Firm*—Birch, Stewart, Kolasch & Birch

[57] ABSTRACT

In an ion beam source, the plasma is contained near the extraction front by a cup-shaped magnetic field for improved stability and uniformity. The intermediate electrode has a profiled electron beam aperture having a first narrowest section, a second slightly wider section, and the third, known, conical section. The anode electrode or anode insert has a very narrow entrance aperture followed by outwardly flared, longer, section.

15 Claims, 8 Drawing Figures

METHOD AND APPARATUS FOR GENERATING ION BEAMS

This is a continuation-in-part of prior application Ser. No. 703,502, filed Feb. 20, 1985.

FIELD OF THE INVENTION

The present invention relates to an ion beam source and, more particularly, to a hot-cathode reflex arc (duoPIGatron) ion beam source wherein electrons from the hot cathode are confined in a reflex region radially by a magnetic field and axially by electrostatic mirrors. These electrons which reflect back and forth between the mirrors ionize a gas contained in an arc chamber.

BACKGROUND OF THE INVENTION

In an article entitled "Ion Implantation of Surfaces" by S. Thomas Picraux and Paul S. Peercy in the March, 1985 issue of Scientific American (at page 102), the authors outline the importance of ion beam implantation technology in the manufacture of Integrated Circuits and in ion-beam modification of metal surfaces. The latter is an emerging technology, while the former is a maturing technology now at the stage of Very Large Scale Integration (VLSI), where, according to the authors, sharply focused ion beams offer much higher resolution than electron beams and visible light. Such sharply focused ion beams would permit defining doped features, without intervening steps of masking, of less than a micrometer across, whose electrical activity might be controlled by as few as 100 dopant atoms.

There are three well defined physical indicia of the source ion plasma and the therefrom derived ion beam that affect controlled implantation and sharp focusing. They are:

beam ion temperature
plasma potential; and
plasma fluctuations.

One beam characteristic which sums up the effect of the above three indicia is beam emittance.

Beam emittance is a difficult concept to grasp. It is a measure of the uniformity of beam divergence in a chosen cross-sectional plane. Accordingly, it is measured by scanning the beam plane with a small slit and plotting the divergance of the emerging beamlet in milli-radians against the radial displacement in centimeters of the slit from the central beam axis. The generated plot is called a phase space diagram, the area of which, in units of cm-mrads, is the beam emittance. The smaller the emittance, the more orderly is the ion beam. A related beam characteristic is brightness, which is defined as the beam current divided by the square of emittance. This definition expresses the difficulty of generating powerful, high current, continuous (d.c.) beams, that are well ordered in phase space.

Beam ion temperature is a measure of beam disorder and directly affects the ability to focus it narrowly. It is a measure of the random kinetic energy of ions in the cross-sectional plane. A high temperature beam is a fuzzy one. Beam ion temperature is usually given in electron volt (eV) units, 1 eV being equal to 11,600° K.

Plasma potential is the electrostatic potential of the ion plasma in the space charge region, ahead of beam extraction apertures, with respect to the surrounding reference potential. Low plasma potential reduces erosion and sputtering of the apparatus. It also results in lower beam contamination and lower variation in ion energy. The latter directly affects the ion implantationdeptn definition, which is important in semi-conductor processing.

Plasma fluctuations, sometimes referred to as "noise", are rapid variations in the density of the plasma from which the ions are extracted. For best beam quality, the plasma density must be matched to the strength of the electric field which extracts the ions from the plasma. Plasma fluctuations make it impossible to properly match the density and electric field at all times and thus lead to a loss of beam quality and an increase in the time-averaged emittance.

Ion sources of the duoPIGatron type may be conceptually partitioned into three regions: electron beam generation, plasma generation and ion beam extraction. The present invention concentrates on the region between the electron-emitting hot cathode and the ion beam extraction apertures. Apparently minor design changes in that region directly affect the ion plasma prior to beam extraction. Ion beam quality, as expressed by low beam emittance and low beam temperature, is itself a result of the spacial and physical homogeneity and uniformity of the source ion plasma.

PRIOR ART OF THE INVENTION

U.S. Pat. No. 3,238,414, issued on Mar. 1, 1966, (Kelley et al), discloses a high output duoplasmatron-type ion source. In their ion source, an arc between a hot cathode and an anode generates an electron beam in the path of which a feed gas to be ionized is located. The electron beam ionizes the feed gas and the ionized feed gas (plasma) is drawn through an aperture in the anode to an expansion region defined by a plasma expansion cup extension. The use of the plasma expansion cup extension increases the quantity and quality of the extracted ion beam. However, the expansion cup extension is a simple cylinder. Moreover, the duoplasmatron of Kelly is not a reflex arc source.

U.S. Pat. No. 3,924,134, issued on Dec. 2, 1975, (Uman et al), teaches another type of ion source. This ion source has a cathode filament chamber and an ionization chamber in which two uncoupled dicharges are maintained whose characteristics can be controlled independently. Electrons generated by the discharge in the cathode filament chamber are used to sustain the discharge in the ionization chamber. This double chamber configuration permits the use of an inert gas in the cathode filament chamber and a feed gas in the ionization chamber. A low voltage arc discharge in the inert gas atmosphere, in the cathode filament chamber, minimizes sputtering and prolongs the filament lifetime. Moreover, the entire source is immersed in an axial magnetic field parallel to a line connecting the filament, the aperture between the top chambers and the ion beam extraction orifice. As will be shown later, significant improvement to the stability and uniformity of the ion plasma will be achieved by providing a contoured, plasma confining, magnetic field.

DuoPIGatron-type ion source was proposed in the present inventor's earlier publication, "High Current DC Ion Source Development at CRNL", IEEE Trans. on Nucl. Sci., Vol., NS-26, No. 3, June 1979, pp. 3065-3067, and was described further in articles "A High-Current DC Heavy Ion Source" by M. R. Shubaly, Inst. of Physics Conf. Ser. No. 54, Chapter 7, 1980, pp. 333-338, and "High Current DC Ion Beams" by M. R. Shubaly et al, IEEE Trans. on Nucl. Sci., Vol. NS-30, No. 2, April 1983, pp. 1399-1401.

The ion source described in the above articles is called duoPIGatron and includes a hot cathode and an intermediate electrode defining a cathode chamber in which the hot cathode is positioned in an inert gas atmosphere. The ion source further has a reflex arc chamber which is formed with the intermediate electrode at one end, a plasma aperture plate at the other, and two anodes between the intermediate electrode and the plasma aperture plate. An arc produced between the cathode and the first anode generates a beam of electrons which is led into the reflex arc chamber containing a feed gas to be ionized. The electrons are bounced back and forth between the intermediate electrode and the plasma aperture plate and collide with the feed gas to ionize it. The ionized gas is extracted through holes in the plasma aperture plate.

Even though the ion source of duoPIGatron type described above has improved performances over the earlier ion sources of the U.S. Patents referred to above, with the ion beam source of the present invention, a wider variety of gases can be ionized, gases such as phosphine $PH_3$, arsine $AsH_3$, boron trifluroide $BF_3$, oxygen $O_2$, all of which have not previously been reported.

More importantly, however, while the concave shaped iron nosepiece in the intermediate electrode disclosed in M. R. Shubaly's 1980 paper led to stable operation at a current 50% higher than previously possible, that improvement in the nosepiece combined with two other improvements to the intermediate electrode canal and to the plasma confining magnetic field results in doubling of the current accompanied by an improvement in beam emittance, beam temperature and lower plasma potential. The higher output current and lower emittance synergistically produce a significant increase in brightness of the ion beam source.

Normalized brightness is a useful parameter for comparing the various ion beam sources; it is the ion beam current divided by the normalized emittance squared and is measured in units of Amperes divided by millimeters-milliradians squared. Normalized emittance is the emittance area per unit of arc multiplied by a relativistic factor, which for small ion velocity approximately equals its quotient by the velocity of light. For ion velocities approaching the speed of light, the factor tends toward infinity. Accordingly, it is important to increase ion beam current as the penetrating power of an ion beam, i.e. ion velocity, increases, in order to maintain brightness of the source.

For a state of the art review of ion sources, reference is made to the paper by Roderich Keller entitled "Ion Sources and Low Energy Beam Transport", published in proceedings of the 1984 Linear Accelerator Conference, May 7–11, 1984, Report #GSI-84-11. This paper is incorporated herein by reference.

U.S. Pat. No. 3,546,513, issued Dec. 8, 1970 (Henning), discloses a "High-Yield Ion Source". The patent states under the heading "BACKGROUND OF THE INVENTION":

> Magnetic fields have been used with ion sources for various purposes. One of these is to constrain electrons to paths along magnetic lines which results in greater ion efficiency. In these systems, focusing and shaping of the plasma front from which ions are extracted has been accomplished by the use of shaped extraction electrodes made of materials with various permeabilities. With these devices the extraction geometries are fixed.

It was thus recognized early on, that plasma shaping is important. The means to achieve this via electrodes made of materials with various permeabilities, however, does not appear to be the optimal solution. The contribution of the Henning patent itself was to add a second shaping magnet, which permits the extraction front geometry to be changed so that optimum yields and focusing may be obtained.

SUMMARY OF THE INVENTION

As in the prior art, it is also an object of the present invention to provide an improved ion source which has a large area of uniform plasma (i.e. high current output) in a compact and simple design and gives reproducible and consistent results both over time and from source to source.

The present invention has several features that may be combined to provide an improved ion beam source.

In the course of experimenting with the present ion beam source, it was found that the uniformity and stability of source plasma are enhanced by shaping the electron constraining magnetic field strength to have, near the ion extraction front, volcano-shaped topology. As a result, the bulk of the plasma volume near the extraction front coincides with a valley in the magnetic field strength and is surrounded by rotationally symmetrical higher field strength.

An advantage of the just mentioned feature is a more uniform, and hence stable, plasma front with small fluctuations of c. 2% or less. A further advantage also is that the better confinement of the ionizing electrons results in lower plasma potential. With the design of the preferred embodiment, plasma potential of between 10–20 volts has been possible.

Low plasma potential reduces erosion of components due to sputtering, reduces plasma contamination and reduces variation in ion energy.

Another feature of the present invention is that the intermediate electrode canal, through which the ionizing primary electrons pass into the reflex arc chamber, has a smaller cross-section on the side of the electron emitting cathode. It is, however, not fully understood how such a feature results in improved performance of the apparatus as a whole. One possibility is that it results in better electron beam confinement, permitting a narrower anode aperture, which in turn lowers gas migration towards the cathode away from the region of interest and lowers gas flow requirements. Another possibility is that, since the intermediate electrode is made of magnetic mild steel, the shaping of the canal, together with the concave nosepiece shape known from the prior art, improves the magnetic field strength topology at the extraction front. One limitation on how constricted the canal may become is that too small a cross-section would make arc transfer too difficult and unreliable.

Yet another feature of the present invention is the provision of an anode (or interchangeable anode insert) having a particularly narrow entrance aperture that is as small or slightly larger than the exit aperture of the intermediate electrode canal. Furthermore, the anode aperture flares conically into the reflex arc chamber in order to match the gas flow to the expanded electron beam. The flaring cross-section is profiled to intercept the constant flux of the magnetic field developed by the intermediate electrode. The flaring probably also helps to prevent turbulent gas flow and thus aids in the formation of uniform interaction between the ionizing electron beam and the injected gas.

An improvement in the anode or anode insert that is at an early stage of development is the use of precisely positioned injection slots to introduce the feed gas into the region of the reflex discharge where it will be most effectively utilized. In such embodiment, the gas is injected downwards through slots at the lower periphery of the flared anode cone. This provides increased ionization efficiency, reduced gas flow, and more stable operation of the ion beam source. It also reduces undesired gas migration towards the cathode and, thus, damage to the cathode.

The above features may be used singly or in combinations. In the preferred embodiment all features have, in fact, been implemented to advantage (except for the last mentioned feature) in an experimental ion implanter favourably reported on in the issue of Electronic Design dated Dec. 27, 1984 at page 37.

According to the method aspect of the present invention an improved method for operating an ion beam source is provided comprising:

(a) generating an ionizing electron beam;

(b) generating ionizable atoms; and (c) colliding the electron beam with the atoms in an ionizing chamber to produce an ion plasma in an ion beam extraction region; CHARACTERIZED BY:

(d) generating a confining magnetic field, for both said electron beam and said plasma, having a central region of low field strength substantially coextensive with said plasma at said ion beam extraction region, and having a peripheral region of higher field strength surrounding said central region, thereby aiding stability and uniformity of said ion plasma in the extraction region.

An ion beam source apparatus according to the present invention comprises cathode means in a cathode chamber for generating an electron beam, means for collimating said electron beam, aperture means in said cathode chamber for admitting the collimated electron beam into an ionizing chamber for containing an ion plasma anode means at one end of said ionizing chamber adjacent said aperture means and ion beam extraction means at the opposite end of said ionizing chamber, CHARACTERIZED IN THAT said aperture means is a bore in said cathode chamber having a smaller cross-section adjacent said cathode means, said smaller cross-section being sufficient for electron beam passage therethrough, and said aperture means including a predetermined length thereof having a predetermined cross-section larger than said smaller cross-section.

In a preferred embodiment, the aperture in the cathode chamber comprises first, second and third sections: the first section, adjacent the cathode means, having the smallest cross-section, and the second, intermediate, section having an intermediate cross-section between the smallest cross-section and a larger cross-section of the third section.

In a narrower aspect, the first and second sections of the aperture are cylindrical, while the third section is conical.

From experiments it became apparent that the second, intermediate, section was critical in respect of its length and cross-section, which is slightly larger than that of the first, narrowest section. The length of the latter was not as critical. The third, conical, section is, of course, known from the prior art. As is also well known, the cathode chamber, generally termed the intermediate electrode in the art, is preferrably made of magnetic mild steel and is strongly magnetized by means of a surrounding coil powered by a direct current of several amperes.

Adjacent the bore in the cathode chamber is an anode, or an interchangeable anode insert, separated from the cathode chamber by a very small distance. In order to make the anode aperture as small as possible, its position is chosen to be where the waist of the electron beam is. The narrow aperture is followed by one or more flared (conical) sections. In the preferred embodiment the flaring is accomplished in two sections with two slightly different conical angles in order to facilitate machining. As mentioned earlier, the flaring serves to match the gas flow to the (expanding) electron beam size.

Accordingly, the anode electrode or anode insert of the present apparatus comprises at least two sections, a narrow aperture comparable in cross-section to that of the bore in the cathode chamber, followed by a substantially longer, flared, section of increasing cross-section.

In a narrow aspect of the present invention, the ion beam source comprises a hot cathode for generating electrons. The hot cathode is positioned in a cathode chamber defined by a generally cylindrical, partly conical, intermediate electrode, to which chamber primary gas supply means supply a gas. The intermediate electrode is made of a magnetic material and has a canal at the apex of the conical part of the electrode for admitting the electrons into a generally cylindrical reflex arc chamber via an intermediate region. The reflex arc chamber is axially aligned with, but separated from, the intermediate electrode, and defines the said intermediate region between them. The reflex arc chamber has the intermediate electrode at one end, a plasma aperture plate at the other end and first and second anodes at locations between the ends. The first anode is provided with a hole therein which is axially aligned with the intermediate electrode canal and through which the electrons are admitted into the reflex arc chamber. Secondary gas supply means supply a gas (a feed gas) to be ionized into the reflex arc chamber. The plasma aperture plate has one or more apertures therein through which the ionized gas emerges from the reflex arc chamber. Extraction means are positioned near the plasma aperture plate and comprise accelerating and decelerating electrodes to extract and accelerate the ions emerging from the reflex arc chamber. The intermediate electrode canal is in a stepped configuration at one end nearest to the hot cathode and has a concave opening at the other end facing the intermediate region. The intermediate electrode ring made of a non-magnetic material is located about and connected electrically to the intermediate electrode. There are further provided a compressor coil on the intermediate electrode to create an electron confining magnetic field in the reflex arc chamber and the intermediate region, and power supply means for supplying electric potentials to the cathode, the intermediate electrode, the first and second anodes and the plasma aperture plate so that the electrons admitted into the reflex arc chamber bounce back and forth between the intermediate electrode and the plasma aperture plate and in so doing, ionize the feed gas by colliding with its atoms or molecules.

BRIEF DESCRIPTION OF THE DRAWINGS

The preferred embodiment of the present invention will now be described in detail in conjunction with the annexed drawings, in which.

Through the drawings, a like numeral designates a like-component of the ion beam source.

DETAILED DESCRIPTION OF THE PREFERRED EMBODIMENT

Figure 1:
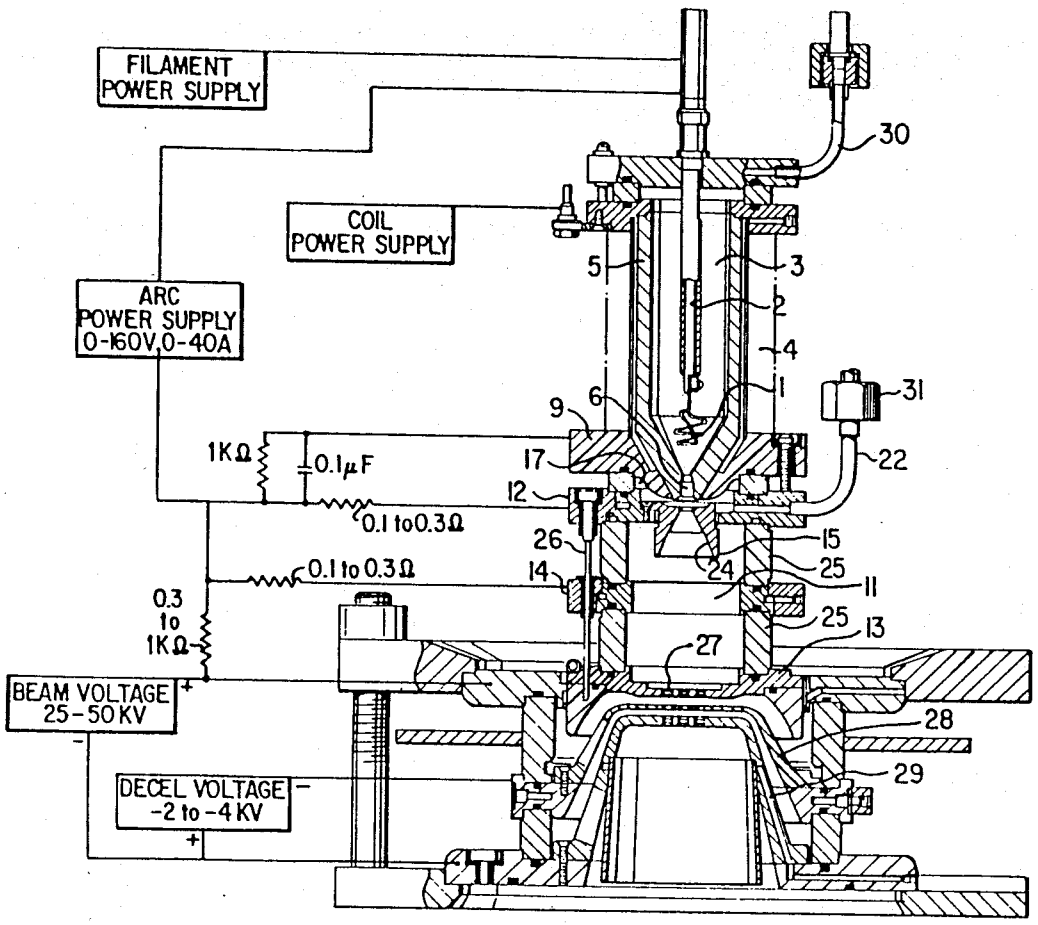
FIG. 1 is a sectional view of the ion beam source according to the present invention.
Figure 2:
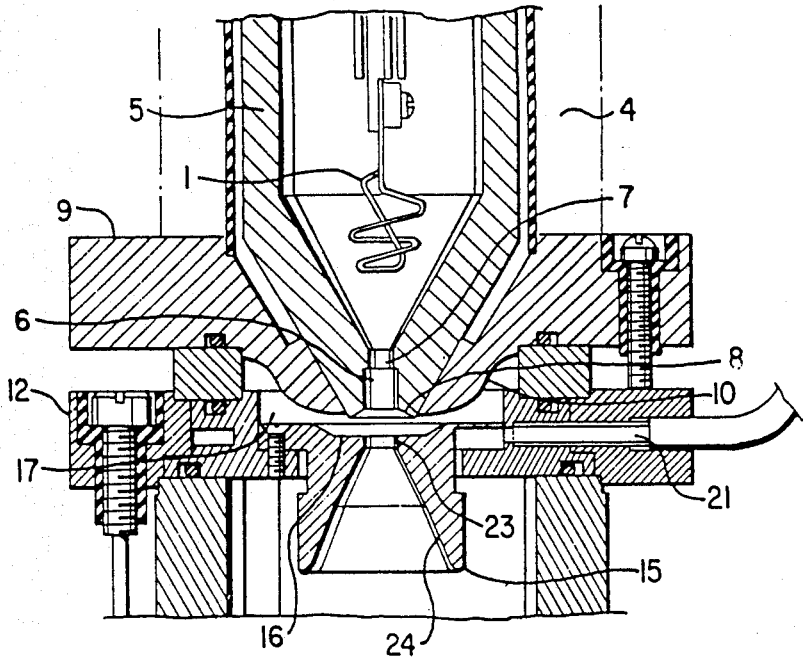
FIG. 2 is an enlarged sectional view of a part of the ion beam source shown in FIG. 1.
Figure 3:
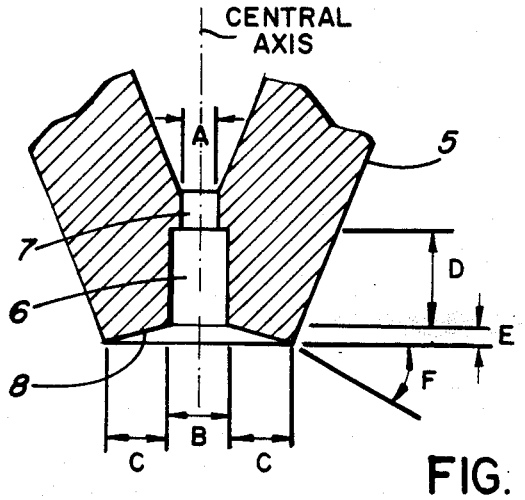
FIG. 3 shows dimensions of the intermediate electrode canal shown in FIG. 2.

Referring to FIGS. 1 and 2 of the drawings, there is shown a hot cathode filament 1 held on a filament holder 2 through which power (typically 2–10 v and 25–100 A) is supplied to the filament. The hot cathode 1 is located in a cathode chamber 3 which is defined by a generally cylindrical, partly conical, intermediate electrode 5 made of a magnetic material, e.g. mild steel. A primary gas supply inlet 30 feeds into the cathode chamber a gas which permits the operation of the filament. Such gas as xenon or argon is mainly used for this purpose. The intermediate electrode holds a compressor coil 4 thereon which provides an excitation of 1800–9000 ampere-turns. At the apex of the conical portion of the intermediate electrode 5, there is provided an intermediate electrode canal having three sections; an intermediate section 6, an entrance section 7 and an exit section 8. The preferred dimensions of the intermediate electrode canal sections 6, 7 and 8 in this embodiment as shown in FIG. 3 are as follows:

A=5.5 mm
B=6.0 mm
C=12.0 mm
D=6.3 mm
E=1.6 mm
F=26°

The dimensions of the intermediate section 6 are the most critical and should be determined experimentally. Its diameter B or cross-sectional area is important for reliable arc transfer. In the preferred embodiment it has been found that the minimum diameter B of the entrance section 7 may not be smaller than 5.8 mm, which permits arc transfer with a probability of 0.9. Increasing B to 6.0 mm permits starting with complete reliability. The reason for keeping the canal diameter as small as possible is that for stable operation and high output current of the source, a higher pressure in the cathode chamber than in the ionizing reflex arc chamber is required.

The length of the entrance section 7 is not as critical and is dictated by the other dimensions.

The concave or conical exit section 8 is quite shallow and is known from the prior art publication (1980) by the present inventor.

An intermediate electrode ring 9 made of non-magnetic material, e.g. copper, surrounds and supports the intermediate electrode 5 about its apex. The intermediate electrode ring 9 has a rounded surface 10 and is electrically connected to the intermediate electrode 5.

A generally cylindrical reflex arc chamber 11 is disposed axially and aligned with the intermediate electrode 5. One end of the reflex arc chamber 11 is defined by the tip of the intermediate electrode 5 followed by a first anode 12 and the other end by a plasma aperture plate 13. A ring-shaped second anode 14 is located at approximately a mid-point between the first anode 12 and the plasma aperture plate 13.

Figure 4:
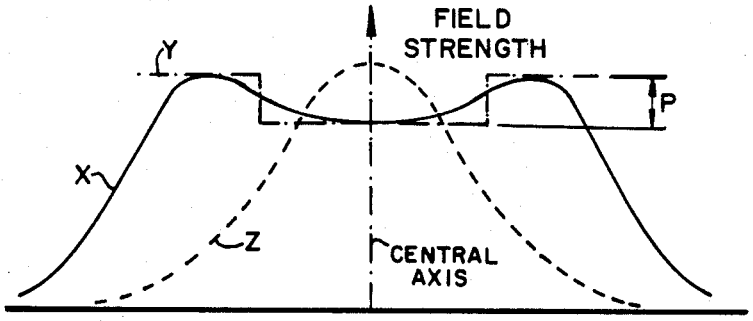
FIG. 4 compares the magnetic field strength pattern according to the present invention to other patterns.
Figure 5:
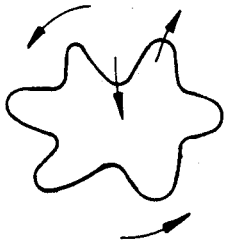
FIG. 5 illustrates plasma flute instability due to non-optimal plasma containment.

The intermediate electrode 5, being made of magnetic mild steel and having a powerful magnetization induced therein, serves to collimate the electrons emitted by the cathode 1 so that they may pass through as narrow as possible a canal aperture. The profiling of the canal into the three sections 6, 7 and 8, in addition to improving electron beam constriction, appears to improve ion plasma confinement near tne plasma aperture plate 13. FIG. 4 shows the magnetic field strength pattern in that region as curve X, which, of course, exhibits rotational symmetry about the central axis. Ideally, the plasma confining field would have the cup-shape of curve Y, whereby the ions would be well confined within the central region. Such field is of course impossible to obtain and curve X is the practical alternative. A field strength pattern with a maximum along the central axis would not offer such stable confinement and often causes what is known in the art as flute instability of plasma, illustrated in FIG. 5. Also, a peaked magnetic field pattern creates a sharply peaked plasma density profile, reducing the useable area of the discharge. In the vicinity of the plasma aperture plate 13, the relative field strength minimum should be only a small percentage P below the field maximum; here $P \approx 5\%$.

Figure 6:
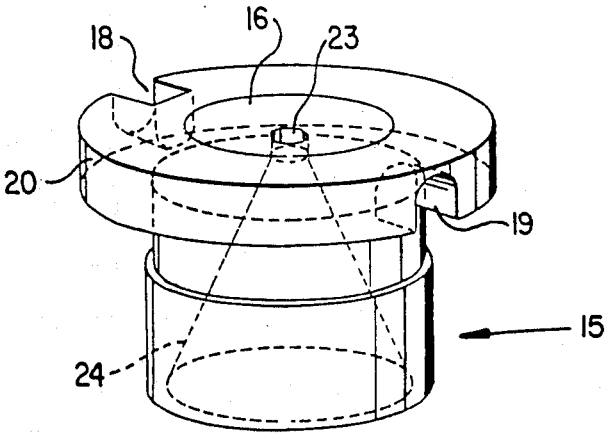
FIG. 6 is a perspective view of an anode insert according to the present invention.

Turning now to FIGS. 2 and 6, the first anode 12 has a hole therein in which an anode insert 15 is rotatably fitted. As shown in the figures a concave surface 16 of the anode insert is shaped to give a predetermined clearance from the front surface 8 of the intermediate electrode 5. The first anode 12, together with the anode insert 15, is aligned with but separated from the intermediate electrode 5 and the intermediate electrode ring 9 to form an intermediate region 17.

The anode insert 15 is shown perspectively in FIG. 6, in which radial ports 18 and 19 are clearly seen milled in a flange 20. The flange is adapted to secure the anode insert 15 against the first anode 12. The port 18 is located in the surface of the flange facing the intermediate electrode and the port 19 is in the other surface of the flange. Either the port 18 or the port 19 can be aligned with a secondary gas passage 21 connected to a secondary gas inlet 22 by turning the anode insert 15 so that a gas can be fed either directly into the reflex arc chamber, as shown in FIG. 2, or indirectly through the intermediate region 17 and then through a bore 23 in the anode insert 15. The bore is located coaxially with the intermediate electrode canal and is flared toward the reflex arc chamber, as shown by numeral 24 in the drawings. The flare cross-section is chosen to intercept a constant flux of the magnetic field emanating from the intermediate electrode 5. It therefore matches the gas flow to the electron beam size.

Figure 7:
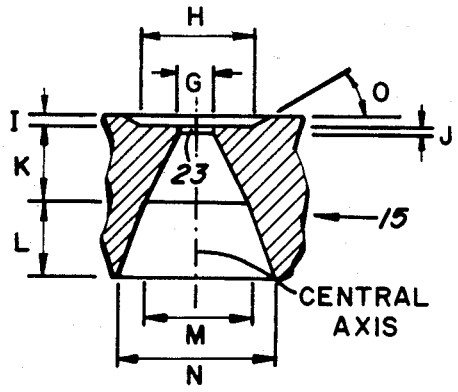
FIG. 7 shows a dimensioned section of the anode insert shown in FIG. 6.

The dimensions of the anode insert 15 are shown in FIG. 7 and are as follows:

G=6.4 mm
H=17.8 mm
I=1.9 mm
J=1.3 mm

K=12.7 mm
L=12.7 mm
M=17.5 mm
N=26.9 mm
O=30°

The flaring of the anode insert 15 is accomplished in two segments, for ease of machining. The flaring of the anode insert 15 is not critical and the use of a single flaring angle would not affect operation to any significant degree.

As is immediately apparent, the bore 23 in the anode insert 15 is only slightly larger than the intermediate section 6 in the intermediate electrode 5. This is advantageous in that it further restricts the migration of the ionizable gases toward the cathode inside the intermediate electrode 5, and permits operation with lower gas flows. Thus consumption of expensive, toxic or corrosive gases is reduced, vacuum pumping is reduced in the system using the ion source, and the production of the desirable atomic, as opposed to molecular, ions is increased. The narrow bore 23 in the anode insert 15 has been made possible by the good confinement of electrons passing through the intermediate electrode canal. The bore 23 is positioned advantageously at the waist of the electron beam.

Figure 8:
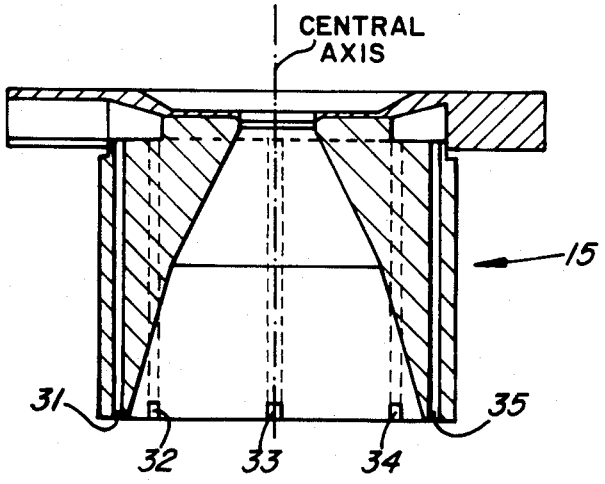
FIG. 8 shows a section of an alternative design of the anode insert.

In an alternative design of the anode insert, shown in FIG. 8, the ionizable gas is injected through slots 31 to 38, of which only slots 31 to 35 are seen in FIG. 8, in the lower periphery of the skirt of the anode insert 15. This increases the efficiency and improves the stability of the arc discharge. Since the gas is injected into the most favorable region for ionization, the necessary gas flow is reduced.

Operation

Referring to FIG. 1, the first anode 12, a second anode 14 and the plasma aperture plate 13, all being made of a non-magnetic material, are stacked together with insulators 25 between them. Clamp rods 26 clamp them together to form the major part of the reflex arc chamber 11. The plasma aperture plate 13 is provided with a plurality of apertures 27. There are three apertures in one preferred embodiment of the present invention, and in another preferred emodiment seven apertures are provided of which six are located in a hexagonal array and the seventh in the center thereof. An accelerating electrode 28 and a decelerating electrode 29 disposed adjacent to the plasma aperture plate 13 have also a corresponding number of apertures which are all aligned with the apertures 27 of the plasma aperture plate. It is of course possible to use in other embodiments one or more apertures.

Appropriate power supplies are shown in FIG. 1 and suitable coolant passages are also provided in various elements to maintain properly the operating temperature of the ion beam source. However, only a few of the passages are shown in the drawings.

In the operation of the duoPIGatron of the present invention, a protective cover gas, e.g. argon or xenon, is introduced into a cathode chamber through the primary gas inlet 30 and the cathode filament is heated to produce electrons for discharge. The electrical discharge is caused between the cathode (negative) and the anode (positive). Inside the mild steel intermediate electrode 5, there is no magnetic field from the compressor coil 4. However, when the electrons exit this region through the intermediate electrode canal, they are in a strong magnetic field. It should be noted that the intermediate electrode ring 9, the anodes 12 and 14 and the plasma aperture plate 13 are made of a non-magnetic material. By the strong magnetic field, the electrons are constrained to spiral along the magnetic field lines forming tight helical paths. These field lines do not intersect the anodes so that the electrons cannot go directly to them. The plasma aperture plate is at a negative potential relative to the two anodes to reflect back the electrons flowing along the field lines towards the intermediate electrode 5, which is also kept at a negative potential. The electrons thus bounce back and forth (or reflex) between the plasma aperture plate 13 and the intermediate electrode 5. Meanwhile, the reflex arc chamber is fed with a feed gas to be ionized through the secondary gas inlet 22 and the secondary gas passage 21. In the anode insert 15 of FIG. 6, the ports 18 and 19 permit the feed gas to be fed into the reflex arc chamber either directly or through the bore 23 via the intermediate region 17. The type of gas used as the feed gas dictates the choice of port to obtain the optimum performance. The reflexing electrons collide with the feed gas atoms or molecules and ionize them. The efficiency of the duoPIGatron comes from this containment of the electrons. The electrons are used many times and not lost after one transit of the ion source.

The accelerating electrode 28 and decelerating electrode 29 form an extraction column and function to pull positive ions from the plasma which exists in the reflex arc chamber through a plurality of apertures in the plasma aperture plate 13 and to form the ions into a beam with a desired energy. Typically, a potential of thirty to fifty thousand volts is applied between the plasma aperture plate and the accelerating electrode. The ions from the plasma pass through the apertures in the plasma aperture plate and are accelerated toward the accelerating electrode. The apertures in the plasma aperture plate are contoured to control the shape and uniformity of the extracted ion beam. The accelerating electrode is kept at a small negative potential (typically three thousand volts) with respect to the decelerating electrode 29 which is at the ground potential. This forms a potential barrier which prevents electrons formed below the extraction column from being accelerated back towards the reflex arc chamber, producing high X-ray fields and causing sparking.

It has been described that a gas, e.g. argon or xenon, is supplied in the cathode chamber 3 to protect the filament 1 from being damaged by the feed gas which is supplied by the secondary gas supply means. However, if argon, xenon, nitrogen, hydrogen and neon, or other gases which do not damage the filament in operation, is the gas to be ionized, it can be introduced through the primary gas inlet without the use of the secondary gas inlet which is to be closed by a valve (not shown). Such gas flows into the reflex arc chamber from the cathode chamber through the electrode canal and the bore in the anode insert.

The diameter and length of the reflex arc chamber are chosen to give a large uniform area of plasma and to provide stable arc operation. If the diameter of the chamber is made smaller or the length shorter, the usable extraction area is decreased. Extending the length past the values of the present embodiment leads to unstable operation. In the present embodiment, they are 57 mm in diameter and 79 mm in length.

The main application of the present invention would be in semi-conductor implanters. These devices are used to implant desired dopants into silicon wafers to fabricate the integrated circuits that are used in a wide range of computer and other electronic systems. The ion sources presently used in these implanters are limited to currents of =12.5 mA of phosphorous and arsenic and =5 mA of boron. The boron is especially a limitation since wafer cooling is adequate for currents of 15 mA at 100 keV and 30 mA at 50 keV. Table 1 gives some typical output currents from the duoPIGatron of the present invention, running on arsine, phosphine and boron trifluoride. These initial measurements were made with only three apertures (5 mm dia.) open. Values are given for the useful species from three apertures (as measured) or from seven apertures (as would most likely be used). The current extracted depends on the open area of the plasma plate within a circle of approximately 2 cm radius.

Another related application is the formation of buried oxide layers in silicon wafers. This requires a high current of oxygen as one is forming significant quantities of $SiO_2$. Presently used sources provide approximately 4 mA of $O^+$ ions and lead to implant times of up to eight hours. Approximately sixty percent of atomic oxygen ions ($O^+$) were available with 100 mA total beam current from three apertures. Under the same operating conditions, a total beam current of 250 mA was extracted from seven aperture. Therefore, as shown in Table 1, up to 140 mA of $O^+$ is available from the source, leading to implant times of the order of 20 minutes. This is a factor of 25 improvement in throughput, assuming that the wafer cooling and handling does not limit the usable current.

Some more future applications are nitrogen implantation into steel for wear improvement, and the use of ion beams to control and modify the properties of materials being built up by evaporation or other processes. Both of these, as with the oxygen application, require high currents.

TABLE 1

| | Beam Currents with Various Gases | | | | |
|---|---|---|---|---|---|
| | Arc | 3 Aperture | Port in the | Current of Sample Species | |
| Feed Gas | (A) | Beam (mA) | Anode Insert | 3-Aperture | 7-Aperture |
| Phosphine + Xe | 8 | 48 | lower | $P^+$ 25 mA | 58 mA |
| Phosphine + Ar | 8.5 | 40 | lower | $P^+$ 15 mA | 35 mA |
| Arsine + Xe | 7.5 | 40 | lower | $As^+$ 13.6 mA | 32 mA |
| Boron | 7.5 | 38 | upper | $B^+$ + 6.4 mA | 14.9 mA |
| Trifluoride + Ar | 9.5 | 48 | lower | $BF_2$ 26.2 mA | 61 mA |
| Oxygen + Ar | 10.5 | 100 | lower | $O^+$ 60 | 140 |
| Nitrogen | 12 | 190* | fed through primary gas inlet | not mass analyzed | |
| Hydrogen | 14 | 650* | fed through primary gas inlet | — | $H_1^+$ 350 mA |
| Argon | 13 | 155* | fed through primary gas inlet | — | $A^{++}$ 150 mA<br>$A^+$5 mA |
| Xenon | 10 | 99* | fed through primary gas inlet | — | $Xe^{++}$ 96 mA<br>$Xe^+$ 3 mA |
| Neon | 14 | 91* | fed through primary gas inlet | not mass analyzed | |

*current from 7 apertures

What is claimed is:

1. An ion beam source apperatus of the type comprising cathode means in a cathode chamber for generating an electron beam, means for collimating said electron beam, aperture means in said cathode chamber for admitting the collimated electron beam into an ionizing chamber for containing an ion plasma, anode means at one end of said ionizing chamber adjacent said aperture means, and ion beam extraction means at the opposite end of said ionizing chamber, CHARACTERIZED IN THAT said aperture means is a bore in said cathode chamber having a smaller cross-section adjacent said cathode means, said smaller cross-section being sufficient for electron beam passage therethrough, and said aperture means including a predetermined length thereof having a predetermined uniform cross-section larger than said smaller cross-section.

2. The apparatus as defined in claim 1, said aperture means in said cathode chamber comprising first, second and third sections; the first section, adjacent the cathode means, having the smallest cross-section; and the second, intermediate, section having an intermediate cross-section between the smallest cross-section and a larger cross-section of the third section.

3. The apparatus as defined in claim 2, said first and second sections being cylindrical.

4. The apparatus as defined in claim 3, said third section being conical.

5. The apparatus as defined in claims 1, 3 or 4, said second section having predetermined cross-section and length to ensure arc transfer with a corresponding predetermined reliability.

6. The apparatus as defined in claims 1, 2 or 3, further CHARACTERIZED BY an anode electrode comprising two sections; a first, narrow, aperture comparable in cross-section to said bore in the cathode chamber; and a second, conical, substantially longer section flared outwardly to provide increasing cross-section in a predetermined manner.

7. The apparatus as defined in claims 1, 2 or 3, further CHARACTERIZED BY an anode electrode having a narrow entrance for said electron beam followed by a substantially conical, longer, expansion having symmetrically disposed gas injection apertures for inwardly injecting an ionizable gas to intersect and collide with said electron beam.

8. An ion beam source comprising a hot cathode for generating electrons and being positioned in a cathode chamber to which a gas is supplied by a primary gas supply means, a generally cylindrical, partly conical, intermediate electrode made of a magnetic material defining the cathode chamber and having an electrode canal therein at the apex of the conical part for admitting the electrons into a generally cylindrical reflex arc chamber via an intermediate region, the reflex arc chamber being axially aligned with but separated from the intermediate electrode and defining the said intermediate region therebetween, the said reflex arc chamber having the intermediate electrode at one end, a plasma aperture plate at the other end and first and second anodes at locations between said ends, the first anode being provided with a hole therein which is axially aligned with the electrode canal and through which the electrons are admitted into the reflex arc chamber, secondary gas supply means for supplying a gas to be ionized into the reflex arc chamber, the plasma aperture plate having one or more apertures therein through which the ionized gas emerges from the reflex arc chamber and extraction means positioned near the plasma aperture plate comprising accelerating and decelerating electrodes to extract and accelerate ions emerging from the reflex arc chamber, wherein the electrode canal is in a stepped configuration having a narrow uniform cross-section at one end nearest to the hot cathode followed by a larger uniform cross-section and ending in a concave opening at the other end facing the intermediate region, an intermediate electrode ring made of a non-magnetic material is located about and connected electrically to the intermediate electrode and there are further provide a compressor coil on the intermediate electrode to create an electron confining magnetic field in the reflex arc chamber and the intermediate region and power supply means for supplying electrical potentials to the cathode, the intermediate electrode, the first and second anodes and the plasma aperture plate so that the electrons admitted into the reflex arc chamber bounce back and forth between the intermediate electrode and the plasma aperture plate and, in so doing, ionize the gas in the reflex arc chamber by colliding therewith.

9. The ion beam source of claim 8 wherein a generally cylindrical anode insert made of a non-magnetic material is rotatably fitted in the hole of the first anode, the anode insert having an inside bore which is flared to match the electron confining magnetic field created by the compressor coil.

10. The ion beam source of claim 9, wherein the first anode has passage means connected to the secondary gas supply means and the anode insert has a flange to secure the anode insert against the first anode, the said flange having one radial port milled in one surface thereof and another radial port in the other surface so that either port can be aligned with the passage means by rotating the anode insert.

11. The ion beam source of claim 10, comprising further means for closing the secondary gas supply means so that a gas can be introduced through the primary gas supply means to the cathode chamber and then to the reflex arc chamber to be ionized by the electrons.

12. The ion beam source of claim 11, wherein the gas to be introduced through the primary gas supply means is a gas selected from a group consisting of argon, xenon, nitrogen, hydrogen and neon.

13. The ion beam source of claim 10, wherein the gas to be supplied by the primary gas supply means is a gas selected from a group consisting of argon, xenon, nitrogen, hydrogen and neon, and the gas to be supplied by the secondary gas supply means is a gas selected from a group consisting of argon, xenon, nitrogen, hydrogen, neon, phosphine, arsine, boron trifluoride and oxygen.

14. The ion beam source of claims 8, 9 or 10, wherein the canal said narrow uniform cross-section is cylindrical and has a diameter of 5.5 mm and said larger uniform cross-section is cylindrical and has a diameter of 6.0 mm.

15. The ion beam source of claims 11, 12 or 13, wherein said narrow uniform cross-section is cylindrical and has a diameter of 5.5 mm and said larger uniform cross-section is cylindrical and has a diameter of 6.0 mm.

* * * * *